US006973926B2

(12) United States Patent
Ohkuma

(10) Patent No.: US 6,973,926 B2
(45) Date of Patent: Dec. 13, 2005

(54) AIR-FUEL RATIO CONTROL APPARATUS FOR INTERNAL COMBUSTION ENGINE AND METHOD THEREOF

(75) Inventor: Shigeo Ohkuma, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/895,348

(22) Filed: Jul. 21, 2004

(65) Prior Publication Data

US 2005/0016513 A1 Jan. 27, 2005

(30) Foreign Application Priority Data

Jul. 23, 2003 (JP) ..... 2003-278480

(51) Int. Cl.[7] ..... F02D 41/14; G01M 15/00

(52) U.S. Cl. ..... 123/697; 73/23.32; 123/681; 123/688

(58) Field of Search ..... 123/670, 681, 123/682, 683, 684, 688, 697; 73/23.31, 23.32; 60/274, 276

(56) References Cited

U.S. PATENT DOCUMENTS

| | | | | |
|---|---|---|---|---|
| 4,694,809 | A * | 9/1987 | Nakano et al. | 123/697 |
| 4,915,082 | A * | 4/1990 | Uchinami et al. | 123/697 |
| 5,901,553 | A * | 5/1999 | Cullen | 123/697 |
| 5,928,303 | A | 7/1999 | Sakai | |
| 6,304,813 | B1 | 10/2001 | Ikeda et al. | |
| 6,347,544 | B1 * | 2/2002 | Hada et al. | 73/23.32 |
| 6,476,364 | B1 * | 11/2002 | Shimamura et al. | 123/697 |
| 6,712,054 | B2 * | 3/2004 | Hosoya et al. | 123/697 |
| 6,848,439 | B2 * | 2/2005 | Ohkuma | 123/688 |
| 2003/0084892 | A1 * | 5/2003 | Ohkuma | 123/688 |
| 2005/0000504 | A1 | 1/2005 | Ohkuma | |

FOREIGN PATENT DOCUMENTS

| | | | | |
|---|---|---|---|---|
| DE | 100 15 282 | A1 | 11/2000 | |
| DE | 10 2004 032 469 | A1 | 2/2005 | |
| JP | 59087244 | A * | 5/1984 | 123/697 |
| JP | 9-88688 | A | 3/1997 | |

OTHER PUBLICATIONS

U.S. Appl. No. 10/895,369, filed Jul. 21, 2004, Ohkuma.

* cited by examiner

*Primary Examiner*—Willis R. Wolfe, Jr.
(74) *Attorney, Agent, or Firm*—Foley & Lardner LLP

(57) ABSTRACT

In a low rotation speed and low load operation region of an internal combustion engine, the heating of an air-fuel ratio sensor by a heater is stopped, and also an air-fuel ratio feedback control is stopped, and just after the heating of the air-fuel ratio sensor by the heater and the air-fuel ratio feedback control are started, a smoothing degree of a detection signal of the air-fuel ratio sensor is set to be small, to perform the air-fuel ratio feedback control based on the smoothed detection signal.

20 Claims, 2 Drawing Sheets

14
10
C/U
13,13a
7
8
5
6
4
1
12
3
2
11

AIR-FUEL RATIO CONTROL APPARATUS FOR INTERNAL COMBUSTION ENGINE AND METHOD THEREOF

FIELD OF THE INVENTION

The present invention relates to an air-fuel ratio control apparatus and a method thereof, for feedback controlling an air-fuel ratio of an air-fuel mixture of an internal combustion engine according to the concentration of a specific component in an exhaust gas of the internal combustion engine.

RELATED ART

Japanese Unexamined Patent Publication No. 09-088688 discloses an air-fuel ratio control apparatus in which a heater is disposed on an air-fuel ratio sensor detecting an air-fuel ratio of an air-fuel mixture based on the oxygen concentration in an exhaust gas, and the air-fuel ratio sensor is heated by the heater, to be kept in an activated condition.

In an internal combustion engine for motorcycle, generally, the engine displacement is small and also the thermal capacity of an exhaust pipe is small, compared with an internal combustion engine for automobile.

Therefore, in the internal combustion engine for motorcycle, when an exhaust heat amount is small, such as an idle operating time, sometimes, a temperature change in an exhaust system is large and condensed water is generated.

Then, if the condensed water hits the air-fuel ratio sensor in a state where the air-fuel ratio sensor is heated by the heater, an element of the air-fuel ratio sensor is cracked due to a thermal shock.

Therefore, it becomes necessary to stop the power supply to the heater when the heat amount from the exhaust is small, such as the idle operating time of the internal combustion engine.

Further, if the power supply to the heater is stopped, the air-fuel ratio sensor cannot be kept in the activated condition, and therefore, it is also necessary to stop an air-fuel ratio feedback control.

However, if the power supply to the heater is stopped in order to avoid the element crack, a delay occurs until the air-fuel ratio sensor is fully warmed up, when the power supply to the heater is resumed to start the air-fuel ratio feedback control.

Then, there is caused a problem in that since a response characteristic of the air-fuel ratio sensor is lowered during a period of time until the air-fuel ratio sensor is fully warmed up, the accuracy of feedback control is significantly lowered.

SUMMARY OF THE INVENTION

The present invention has an object to provide an air-fuel ratio control apparatus and an air-fuel ratio control method, capable of preventing the accuracy of an air-fuel ratio feedback control from being lowered while avoiding an element crack.

In order to achieve the above object, the present invention is constituted so that a concentration detection signal from an exhaust component concentration detector is smoothed, and an air-fuel ratio feedback control signal is calculated based on the smoothed concentration detection signal; and also, it is judged whether or not a low temperature condition of the exhaust component concentration detector is established, and a smoothing degree of the concentration detection signal is set to be a normal value when the low temperature condition is not established but to be a value less than the normal value when the low temperature condition is established.

The other objects and features of this invention will become understood from the following description with reference to the accompanying drawings.

DESCRIPTION OF EMBODIMENT

Figure 1:
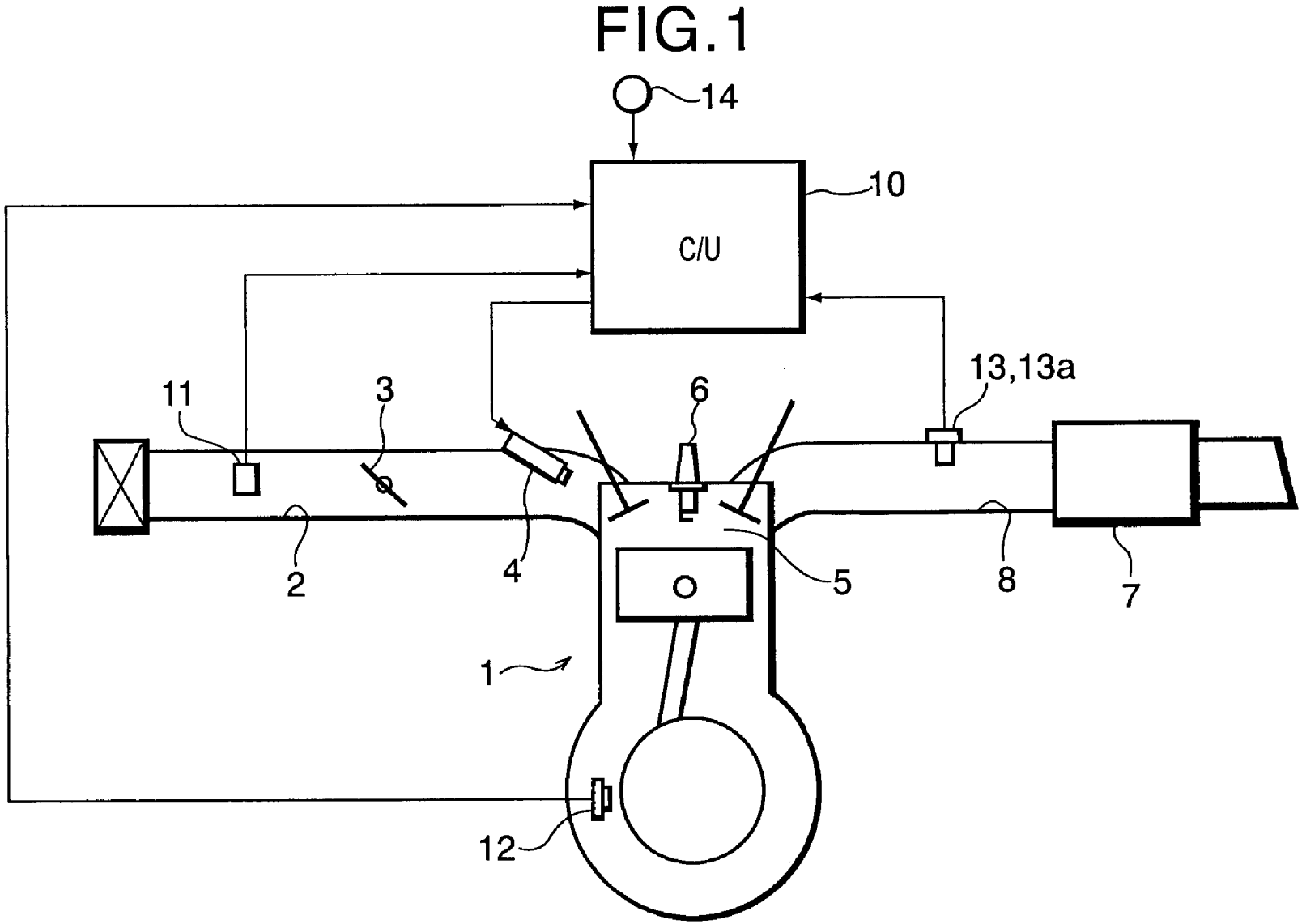
FIG. 1 is a diagram showing a system configuration of an internal combustion engine in an embodiment.

FIG. 1 is diagram showing a single-cylinder internal combustion engine for motorcycle in an embodiment.

In FIG. 1, a throttle valve 3 is disposed in an intake pipe 2 of an internal combustion engine 1.

Throttle valve 3 adjusts an intake air amount of internal combustion engine 1.

A fuel injection valve 4 is disposed in intake pipe 2 on the downstream of throttle valve 3.

In a combustion chamber 5 of internal combustion engine 1, an air-fuel mixture is formed of fuel injected from fuel injection valve 4 and air passed through throttle valve 3.

The air-fuel mixture is ignited to burn in combustion chamber 5, with spark ignition by an ignition plug 6.

Combusted exhaust gas of internal combustion engine 1 is discharged via an exhaust pipe 8, on which is disposed a catalytic converter 7, into the atmosphere.

Fuel injection valve 4 is driven to open according to an injection pulse signal from a control unit 10.

A fuel injection quantity by fuel injection valve 4 is controlled based on pulse width of the injection pulse signal.

Control unit 10 incorporates therein a microcomputer.

Control unit 10 receives detection signals from various sensors, to output the injection pulse signal by the calculation process based on the detection signals.

As the various sensors, there are provided an air flow meter 11 detecting the intake air amount of internal combustion engine 1 at the upstream side of throttle valve 3, a rotation sensor 12 detecting a rotation speed of internal combustion engine 1, an air-fuel ratio sensor 13 detecting the oxygen concentration inside exhaust pipe 8 on the upstream side of catalytic converter 7 to detect an air-fuel ratio, and a vehicle speed sensor 14 detecting a running speed of the motorcycle.

Air-fuel ratio sensor 13 is provided with a heater 13*a* heating a sensor element.

Note, air-fuel ratio sensor 13 may be the one detecting in a wide range the air-fuel ratio from the oxygen concentration in the exhaust gas, or the one only detecting whether the air-fuel ratio is richer or leaner than a stoichiometric air-fuel ratio.

Here, control unit 10 feedback controls the fuel injection quantity by fuel injection valve 4, so that the air-fuel ratio detected by air-fuel ratio sensor 13 is coincident with the stoichiometric air-fuel ratio.

Further, control unit 10 controls an applied voltage to heater 13*a* provided on air-fuel ratio sensor 13.

Figure 2:
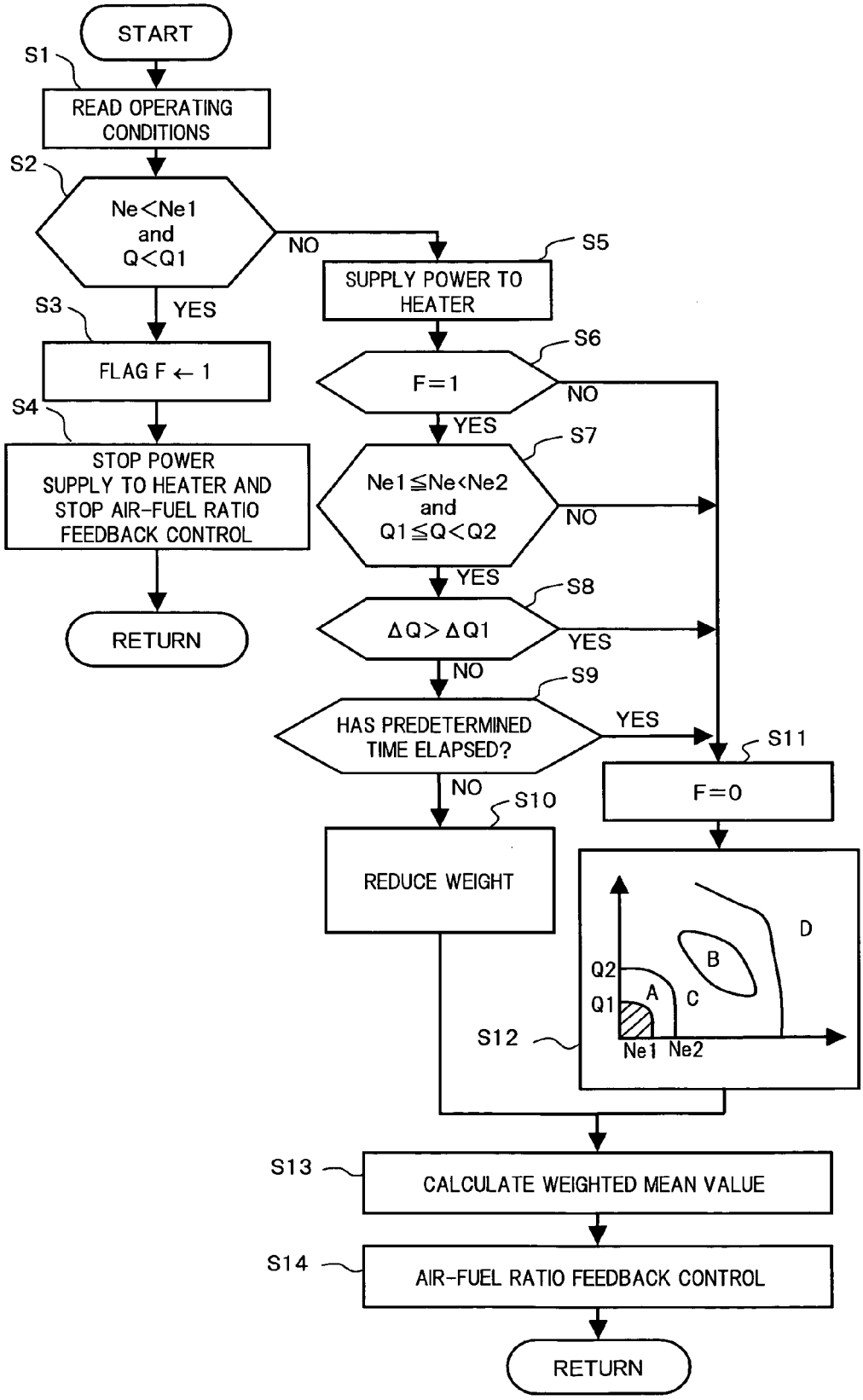
FIG. 2 is a flowchart showing a heater control and an air-fuel ratio feedback control in the embodiment.

A flowchart of FIG. 2 shows a control of the applied voltage to heater 13*a* and the air-fuel ratio feedback control by control unit 10.

In step S1, operating conditions of internal combustion engine 1 including an engine rotation speed Ne and an engine intake air amount Q, are read.

In step S2, it is judged whether or not the engine rotation speed Ne is less than a threshold Ne1 and also the intake air amount Q is less than a threshold Q1.

Here, if it is judged that the engine rotation speed Ne is less than the threshold Ne1 and also the intake air amount Q is less than the threshold Q1, control proceeds to step S3, where 1 is set to flag F.

In next step S4, the power supply to heater 13*a* is shut off and also the air-fuel ratio feedback control is stopped.

In a low load and low rotation speed region of internal combustion engine 1, since the temperature of exhaust pipe is significantly changed on the low temperature side, condensed water is generated.

Then, if the condensed water hits air-fuel ratio sensor 13 heated by heater 13*a*, there is a possibility of element crack due to a thermal shock.

Further, in the operation region of low rotation speed and low load, the necessity for matching accurately the air-fuel ratio with the target air-fuel ratio, is relatively low.

Accordingly, when internal combustion engine 1 is being operated at the low load and low rotation speed, the power supply to heater 13*a* is shut off, to prevent the element from being cracked.

Note, the constitution may be such that a low voltage of the degree at which the element crack can be avoided, is applied to heater 13*a,* when internal combustion engine 1 is being operated at the low load and low rotation speed.

Further, the constitution may be such that the switching between the shutting off of the power supply to heater 13*a* and the application of the low voltage to heater 13*a* can be performed according to an elapsed time after the starting of engine operation, when internal combustion engine 1 is being operated at the low load and low rotation speed.

On the other hand, when it is judged in step S2 that the engine rotation speed Ne is the threshold Ne1 or above and/or the intake air amount Q is the threshold Q1 or above, control proceeds to step S5.

In step S5, a normal power supply control to heater 13*a* is performed.

The normal power supply control means an applied voltage control according to the engine load and the engine rotation speed, an applied voltage feedback control based on the temperature of air-fuel ratio sensor 13 or a control for applying a relatively high constant voltage.

Then, air-fuel ratio sensor 13 is kept at the activation temperature by the normal power supply control.

In next step S6, it is judged whether or not 1 is set to flag F.

When 1 is set to flag F, control proceeds to step S7.

In step S7, it is judged whether or not Ne1≦Ne<Ne2 and also Q1≦Q<Q2 (Q1<Q2) are established.

Namely, as shown in step S12, a region where Ne1≦Ne<Ne2 and also Q1≦Q<Q2 are established, is a region A surrounding the low load and low rotation speed region where the power supply to heater 13*a* and the air-fuel ratio feedback control are stopped.

Accordingly, when it is judged that Ne1≦Ne<Ne2 and also Q1≦Q<Q2 are established, the engine operation corresponds to an operation region just after shifting from the operation region where the power supply to heater 13*a* is stopped.

When it is judged in step S7 that Ne1≦Ne<Ne2 and also Q1≦Q<Q2 are established, control proceeds to step S8.

In step S8, it is judged whether or not a change speed ΔQ of the intake air amount Q exceeds a predetermined value ΔQ1, in other words, whether or not the intake air amount is increasingly changed at a predetermined speed.

When it is judged in step S8 that the change speed ΔQ of the intake air amount Q is the predetermined value ΔQ1 or less, control proceeds to step S9.

In step S9, it is judged whether or not an elapsed time after the starting of power supply to heater 13*a* reaches a predetermined time or above.

When the elapsed time after the starting of power supply is less than the predetermined time, control proceeds to step S10.

In step S10, a relatively small value in conformity with a low temperature condition of air-fuel ratio sensor 13 is set as the weight used in weighted mean processing of the detection signal from air-fuel ratio sensor 13.

The above weight is the weighting to a previous value of when the weighted mean processing is performed on a previous weighted mean value and a newest detection result. By decreasing the weight, the smoothing degree of the detection signal from air-fuel ratio sensor 13 becomes lower.

In the case where control proceeds from step S9 to step S10, the engine operation is in an operation region where the exhaust temperature is low just after the power supply to heater 13*a* is resumed, and also is stabled in the low exhaust temperature region since the change in the intake air amount is small, and also a heating time by heater 13*a* is insufficient.

In such conditions, it is estimated that, since the temperature of air-fuel ratio sensor 13 does not reach the activation temperature, a response characteristic of air-fuel ratio sensor 13 is lowered.

On the other hand, a gain for the air-fuel ratio feedback control is set so as to be in conformity with the response of when the sensor element temperature is high and accordingly, air-fuel ratio sensor 13 is fully warmed up.

Accordingly, if the feedback control is performed normally at the low exhaust temperature time where the response characteristic of air-fuel ratio sensor 13 is lowered, the accuracy of the air-fuel ratio feedback control is lowered.

Therefore, in step S10, the weighting to the previous value of when the weighted mean processing is performed on the detection signal from air-fuel ratio sensor 13, is lowered so that the degradation of response characteristic of air-fuel ratio sensor 13 is offset.

On the other hand, in the case where it is judged in step S7 that Ne1≦Ne<Ne2 and also Q1≦Q<Q2 are not established, control proceeds to step S11.

In the case where it is judged in step S7 that Ne1≦Ne<Ne2 and also Q1≦Q<Q2 are not established, it is judged that the engine operation shifts from the region where the power supply to heater 13*a* is stopped, passing through the region where Ne1≦Ne<Ne2 and also Q1≦Q<Q2 are established, to an operation region where the exhaust temperature is higher.

Further, when it is judged in step S8 that the change speed ΔQ of the intake air amount Q exceeds the predetermined value ΔQ1, it is estimated that the temperature of air-fuel ratio sensor 13 rises immediately due to the abrupt rise of exhaust temperature.

Therefore, also when it is judged in step S8 that the change speed ΔQ of the intake air amount Q exceeds the predetermined value ΔQ1, control proceeds to step S11.

Further, in the case where it is judged in step S9 that the elapsed time after the starting of power supply to heater 13*a* reaches the predetermined time or above, it is estimated that the temperature of air-fuel ratio sensor 13 is sufficiently high due to the heating by heater 13*a*.

Accordingly, also when the elapsed time after the starting of power supply to heater 13*a* reaches the predetermined time or above, control proceeds to step S11.

In step S11, flag F is reset to 0.

In next step S12, the weight adapted to the fully warmed up condition of air-fuel ratio sensor 13 is set according to the intake air amount Q and the engine rotation speed Ne at the time.

In step S12, the setting of the weight to the region A where $Ne1 \leqq Ne < Ne2$ and also $Q1 \leqq Q < Q2$ are established, is also performed. However, the weight to the region A set in step S12 is larger than the weight set in step S10.

Accordingly, when the temperature of air-fuel ratio sensor 13 is sufficiently high, the smoothing degree of the detection result of air-fuel ratio sensor 13 becomes higher.

In step S12, the weight is set so that the smoothing degree becomes higher as the engine rotation speed becomes higher, and also the smoothing degree becomes higher as the engine load becomes larger.

Note, a region B of intermediate load and intermediate rotation speed is a region where the change in air-fuel ratio becomes large due to the resonance in the air-fuel ratio feedback control.

Therefore, in the region B, the weight is made to be larger than that in an intermediate load and intermediate rotation speed region C surrounding the region B, so as to suppress the deflection of air-fuel ratio.

When the weight is set in step S10 or step S12, control proceeds to step S13.

In step S13, a weighted mean value Vout of an output Vin of air-fuel ratio sensor 13 is calculated in accordance with the following equation.

$$Vout(n) = Vout(n-1) \times weight + Vin \times (1 - weight)$$

Note, Vout(n−1) is a previous value of the weighted mean value Vout.

Then, in step S14, an actual air-fuel ratio is calculated based on the weighted mean value Vout, to calculate an air-fuel ratio feedback control signal.

As described in the above, in the present embodiment, the smoothing degree of the detection signal from air-fuel ratio sensor 13 is made to be lower, just after the engine operation shits from the engine load and engine rotation speed region where the power supply to heater 13*a* is stopped.

Thus, in the state of the low response characteristic before the temperature of air-fuel ratio sensor 13 does not rise sufficiently, there does not appear a large difference between the response of air-fuel ratio to be used in the air fuel ratio feedback control and that at the warmed-up time, thereby enabling the prevention of drop of controllability due to the nonconformity of feedback gain.

The entire contents of Japanese Patent Application No. 2003-278480 filed on Jul. 23, 2003, a priority of which is claimed, are incorporated herein by reference.

While only a selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

What is claimed is:

1. An air-fuel ratio control apparatus for an internal combustion engine, comprising:

exhaust component concentration detecting means for detecting the concentration of a specific component in an exhaust gas of said internal combustion engine;

heating means for heating said exhaust component concentration detecting means;

operating condition detecting means for detecting operating conditions of said internal combustion engine; and control means for receiving a concentration detection signal from said exhaust component concentration detecting means and an operating condition detection signal from said operating condition detecting means, to control said heating means based on said operating condition detection signal and also to output an air-fuel ratio feedback control signal based on said concentration detection signal, wherein said control means:

smoothes the concentration detection signal from said exhaust component concentration detecting means, to calculate said air-fuel ratio feedback control signal based on said smoothed concentration detection signal; and also judges whether or not a low temperature condition of said exhaust component concentration detecting means is established, and sets a degree of the smoothing to be a normal value when said low temperature condition is not established but to be a value less than said normal value when said low temperature condition is established.

2. An air-fuel ratio control apparatus for an internal combustion engine, comprising:

an exhaust component concentration detector detecting the concentration of a specific component in an exhaust gas of said internal combustion engine;

a heating device heating said exhaust component concentration detector;

an operating condition detector detecting operating conditions of said internal combustion engine; and a control unit that receives a concentration detection signal from said exhaust component concentration detector and an operating condition detection signal from said operating condition detector, to control said heating device based on said operating condition detection signal and also to output an air-fuel ratio feedback control signal based on said concentration detection signal, wherein said control unit:

smoothes the concentration detection signal from said exhaust component concentration detector, to calculate said air-fuel ratio feedback control signal based on said smoothed concentration detection signal; and also judges whether or not a low temperature condition of said exhaust component concentration detector is established, and sets a degree of the smoothing to be a normal value when said low temperature condition is not established but to be a value less than said normal value when said low temperature condition is established.

3. An air-fuel ratio control apparatus for an internal combustion engine according to claim 2, wherein said control unit judges that said low temperature condition is established, when an elapsed time after the heating by said heating device is started, is within a predetermined time, and also when a load of said internal combustion engine is within a predetermined load range, and also a rotation speed of said internal combustion engine is within a predetermined rotation speed range.

4. An air-fuel ratio control apparatus for an internal combustion engine according to claim 2, wherein said control unit judges that said low temperature condition is established, when an elapsed time after the heating by said heating device is started, is within a predetermined time, and also a load of said internal combustion engine is not increasingly changed at a speed exceeding a predetermined speed.

5. An air-fuel ratio control apparatus for an internal combustion engine according to claim 2, wherein said control unit judges that said low temperature condition is established, when an elapsed time after the heating by said heating device is started, is within a predetermined time, and also when a load of said internal combustion engine is within a predetermined load range, and also a rotation speed of said internal combustion engine is within a predetermined rotation speed range, and also the load of said internal combustion engine is not increasingly changed at a speed exceeding a predetermined speed.

6. An air-fuel ratio control apparatus for an internal combustion engine according to claim 2, wherein said control unit performs the weighted mean processing on the concentration detection signal from said exhaust component concentration detector, to calculate said air-fuel ratio feedback control signal based on a weighted mean value of said concentration detection signal, and also to change the weighting in said weighted mean processing according to whether or not the low temperature condition of said exhaust component concentration detector is established.

7. An air-fuel ratio control apparatus for an internal combustion engine according to claim 2, wherein said control unit judges that said low temperature condition is established, when an elapsed time after the heating by said heating device is started, is within a predetermined time.

8. An air-fuel ratio control apparatus for an internal combustion engine according to claim 7, wherein said control unit stops a heating operation by said heating device and also stops an air-fuel ratio feedback control, when a load of said internal combustion engine is less than a first threshold and also a rotation speed of said internal combustion engine is less than a second threshold.

9. An air-fuel ratio control apparatus for an internal combustion engine according to claim 2, wherein said control unit variably sets said normal value of the smoothing degree according to a load of said internal combustion engine and a rotation speed of said internal combustion engine.

10. An air-fuel ratio control apparatus for an internal combustion engine according to claim 9, wherein said control unit sets said normal value of the smoothing degree to be larger as the load of said internal combustion engine is larger, and also sets said normal value of the smoothing degree to be larger as the rotation speed of said internal combustion engine is higher.

11. An air-fuel ratio control apparatus for an internal combustion engine according to claim 9, wherein said control unit sets said normal value of the smoothing degree in an operation region where the resonance in an air-fuel ratio feedback control occurs, to be larger than the normal value in an operation region adjacent to the operation region where said resonance occurs.

12. An air-fuel ratio control method for an internal combustion engine equipped with an exhaust component concentration detecting device detecting the concentration of a specific component in an exhaust gas of said internal combustion engine and a heating device heating said exhaust component concentration detector, comprising the steps of;

detecting operating conditions of said internal combustion engine;

controlling said heating device based on the operating conditions of said internal combustion engine;

judging whether or not a low temperature condition of said exhaust component concentration detector is established;

setting a degree of the smoothing to be a normal value when said low temperature condition is not established but to be a value less than said normal value when said low temperature condition is established;

smoothing the concentration detected by said exhaust component concentration detector according to said smoothing degree; and feedback controlling an air-fuel ratio of an air-fuel mixture in said internal combustion engine based on said smoothed concentration.

13. An air-fuel ratio control method for an internal combustion engine according to claim 12, wherein said step of judging the low temperature condition judges that said low temperature condition is established, when an elapsed time after the heating by said heating device is started, is within a predetermined time, and also when a load of said internal combustion engine is within a predetermined load range, and also a rotation speed of said internal combustion engine is within a predetermined rotation speed range.

14. An air-fuel ratio control method for an internal combustion engine according to claim 12, wherein said step of judging the low temperature condition judges that said low temperature condition is established, when an elapsed time after the heating by said heating device is started, is within a predetermined time, and also a load of said internal combustion engine is not increasingly changed at a speed exceeding a predetermined speed.

15. An air-fuel ratio control method for an internal combustion engine according to claim 12, wherein said step of judging the low temperature condition judges that said low temperature condition is established, when an elapsed time after the heating by said heating device is started, is within a predetermined time, and also when a load of said internal combustion engine is within a predetermined load range, and also a rotation speed of said internal combustion engine is within a predetermined rotation speed range, and also the load of said internal combustion engine is not increasingly changed at a speed exceeding a predetermined speed.

16. An air-fuel ratio control method for an internal combustion engine according to claim 12, wherein said step of judging the low temperature condition judges that said low temperature condition is established, when an elapsed time after the heating by said heating device is started, is within a predetermined time.

17. An air-fuel ratio control method for an internal combustion engine according to claim 16, wherein said step of controlling said heating device stops a heating operation by said heating device and also stops an air-fuel ratio feedback control, when a load of said internal combustion engine is less than a first threshold and also a rotation speed of said internal combustion engine is less than a second threshold.

18. An air-fuel ratio control method for an internal combustion engine according to claim 12, wherein said step of setting the smoothing degree variably sets said normal value of the smoothing degree according to a load of said internal combustion engine and a rotation speed of said internal combustion engine.

19. An air-fuel ratio control method for an internal combustion engine according to claim 18, wherein said step of setting the smoothing degree sets said normal value of the smoothing degree to be larger as the load of said internal combustion engine is larger, and also sets said normal value of the smoothing degree to be larger as the rotation speed of said internal combustion engine is higher.

20. An air-fuel ratio control method for an internal combustion engine according to claim 18, wherein said step of setting the smoothing degree sets said normal value of the smoothing degree in an operation region where the resonance in an air-fuel ratio feedback control occurs, to be larger than the normal value in an operation region adjacent to the operation region where said resonance occurs.

* * * * *